US005318326A

United States Patent [19]

Garrison

[11] Patent Number: 5,318,326

[45] Date of Patent: Jun. 7, 1994

[54] IDENTIFICATION CARD INTERMEDIATE AND METHOD

[75] Inventor: Ronald R. Garrison, Batavia, Ill.

[73] Assignee: Wallace Computer Services, Inc., Hillside, Ill.

[21] Appl. No.: 35,222

[22] Filed: Mar. 22, 1993

[51] Int. Cl.[5] ..... B42D 15/10

[52] U.S. Cl. ..... 283/101; 156/217; 156/223; 156/227; 156/289; 156/268; 283/109; 428/41

[58] Field of Search ..... 428/41; 283/101, 106, 283/109; 156/216, 217, 223, 226, 227, 289, 268; 40/628, 629, 630, 626

[56] References Cited

U.S. PATENT DOCUMENTS

| | | | |
|---|---|---|---|
| 3,505,140 | 4/1970 | Dunn | 283/109 X |
| 3,854,229 | 12/1974 | Morgan | 283/109 X |
| 4,183,554 | 1/1980 | Howard, Jr. | 283/109 |
| 4,695,077 | 9/1987 | Pretre | 283/81 |
| 4,986,868 | 1/1991 | Schmidt | 156/289 X |
| 5,173,080 | 12/1992 | Longtin | 283/109 X |
| 5,209,514 | 5/1993 | Hebert | 283/109 X |
| 5,230,938 | 7/1993 | Hess et al. | 428/41 X |

FOREIGN PATENT DOCUMENTS

| | | | |
|---|---|---|---|
| 2301059 | 9/1976 | France | 283/109 |

*Primary Examiner*—Michael W. Ball
*Assistant Examiner*—Michele K. Yoder
*Attorney, Agent, or Firm*—Tilton, Fallon, Lungmus & Chestnut

[57] ABSTRACT

An intermediate from an I.D. card and method in which paper equipped with a patch of release material is combined with a film carrying pressure sensitive adhesive. The paper is die-cut in a generally rectangular configuration and so also is the film in a fashion so as to permit folding of the film on itself to encapsulate the card.

7 Claims, 1 Drawing Sheet

Fig. 1
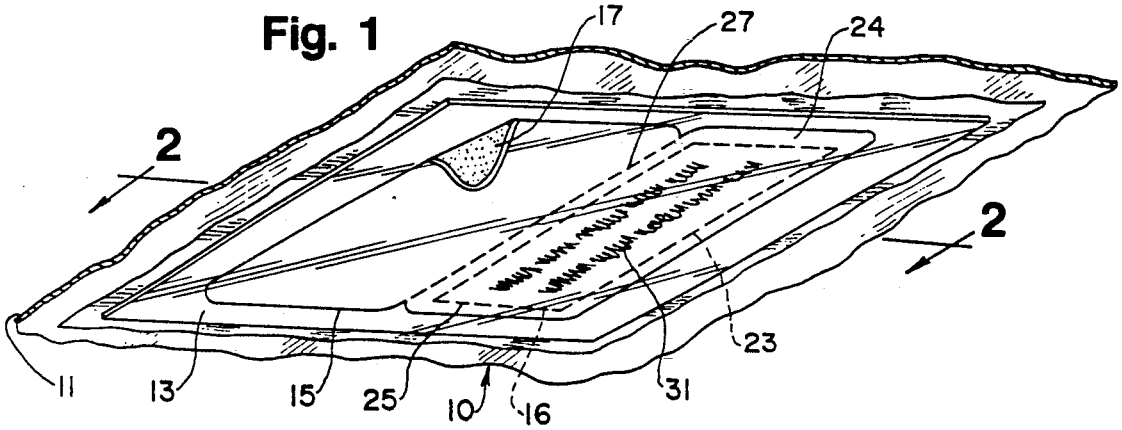
Fig. 2
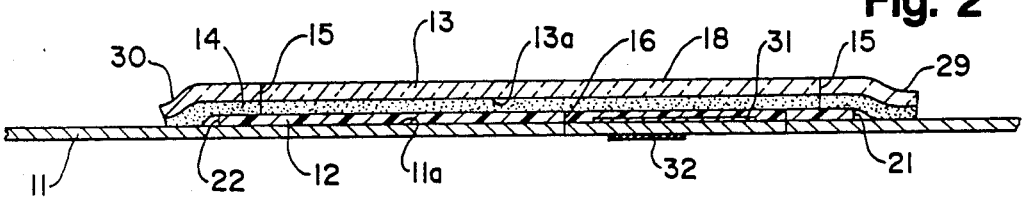
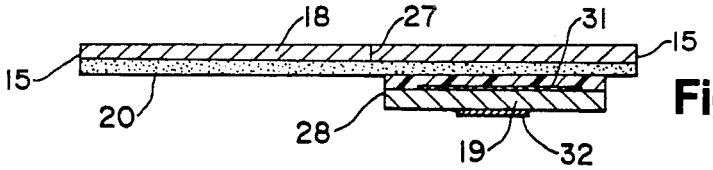
Fig. 3
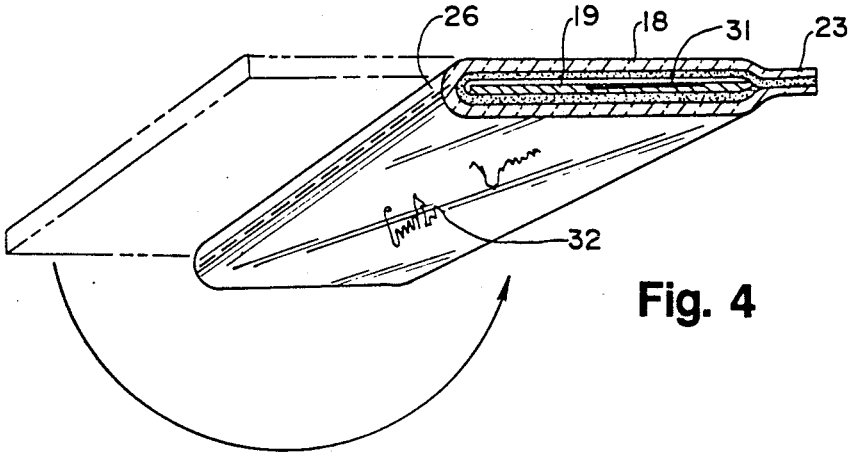
Fig. 4

IDENTIFICATION CARD INTERMEDIATE AND METHOD

BACKGROUND AND SUMMARY OF INVENTION

This invention relates to an identification (I.D.) card intermediate and method and, more particularly, to a form or device which is conveniently delivered to the site of issuance and further conveniently manipulated at that site. As such, the instant invention provides an alternative to co-owned patent U.S. Pat. No. 4,986,868.

According to the instant invention, the intermediate includes a first ply of paper having one face coated with a patch of release material and a second transparent film ply equipped with pressure sensitive adhesive on one surface and which surface is adhesively secured to the paper over the patch. A perimetric die-cut is provided in the paper to define the I.D. card while a larger perimetric die-cut is provided in the film so as to permit folding of the film around the I.D. card for complete encapsulation.

Other objects and advantages of the invention may be seen in the details of the ensuing specification.

BRIEF DESCRIPTION OF DRAWING

The invention is explained in conjunction with an illustrative embodiment, in which—

FIG. 1 is a fragmentary perspective view of the inventive intermediate in the initial stage of issuance;

FIG. 2 is a sectional view as would be seen along the sight line 2—2 applied to FIG. 1;

FIG. 3 is a view similar to FIG. 2 but showing a portion of the film and the I.D. card separated from the paper stock; and FIG. 4 is a perspective view showing the final stage of encapsulating the I.D. card at the time of issuance.

DETAILED DESCRIPTION

Referring first to FIG. 1, the numeral 10 designates generally the structure that is an intermediate to the final I.D. card. As seen both in FIGS. 1 and 2, the numeral 11 designates the paper ultimately providing the I.D. card and which advantageously may be of bond, card stock, etc. The paper may be provided as individual units, each providing an single I.D. card or a connected series of units such as is normally employed for computer printer processing.

In any event, the surface 11*a* of paper 11 in a predetermined area is equipped with a patch 12 of release material—see FIG. 2. Conventionally, release material is a form of a silicone so as to permit ready detachment of a label, film, or the like etc. which is equipped with pressure sensitive adhesive film, or the like etc. which is equipped with pressure the film upon detachment of the film from the patch-equipped paper.

Overlying the patch 12 is a transparent film 13 which advantageously may be constructed of Mylar and which, on its underside 13*a* is equipped with a layer of pressure sensitive adhesive 14.

The film 13 is equipped with a generally rectangular die-cut 15 and the paper 11 is equipped with a smaller generally rectangular die-cut 16. As a consequence, when the die-cut portion of the film 13 is peeled back as at 17 in FIG. 1, there is removed a blank 18 of film (see FIG. 3) which has attached thereto the I.D. card 19. Then, when the overlapped portion 20 of the film 18 is pivoted in the fashion indicated in FIG. 4, the I.D. card is completely encapsulated.

Structural Details

Referring again to FIG. 2, it will be seen that the patch 12 extends from the edge 21 at the right to the edge 22 at the left. This insures that the film blank 18 between the die-cuts 15 (see also FIG. 3) is completely confronted by release material. However, the I.D. card 19 is itself smaller than one-half of the patch as can readily be appreciated from a consideration of FIG. 3. On the other hand, the film 13 and particularly the blank 18 is slightly greater than twice the size of the I.D. card 19 so as to completely encapsulate the same. As can be readily appreciated from a consideration of FIG. 4, there is a portion of the film blank 18 which extends beyond the card 19 as at 23. This overlap is also indicated at the right in FIG. 1. Further, the blank 18 overlaps the I.D. card along other sides as at 24 and 25 to provide a generally U-shaped connective portion closing three sides of the I.D. card. The fourth side is closed as at 26 (see FIG. 4) by the fold of the blank 18 and which is facilitated by providing a line of perforation 27 (see also the upper part of FIG. 1).

It will be noted that the die-cut 16 developing the I.D. card is adjacent one side of the generally rectangular patch of release material 12 so as to position the line of perforation 27 slightly outboard of the inner edge 28 of the I.D. card 19 (see FIG. 3).

Also found advantageous is to extend the film 13 slightly beyond the patch 12 as can be appreciated from both the right and left hand portions of FIG. 2 as at 29 and 30. Thus, there is a thin edge portion of the film which is adhered directly to the paper 11 and which prevents inadvertent detachment of the film from the paper during handling, shipment, manipulation, etc.

In the instance where the I.D. card is issued by a store, club, etc. and identification is desirable or advantageous of the issuer, the card may be pre-printed as at 31 with such information as the address, phone number, and the like of the issuer. Then, when the intermediate is about to be used at the site of issuance, the recipient can sign the card as at 32 which is on the face of the paper 11 opposite to that equipped with the patch 12. Then, when the combined film and I.D. card are separated from the remainder of the paper—to reach the configuration of FIG. 3—the card is already signed and can be permanently encapsulated as illustrated in FIG. 4.

While in the foregoing specification a detailed description of an embodiment of the invention has been set down for the purpose of illustration, many variations may be made in the details hereingiven without departing from the spirit and scope of the invention.

I claim:

1. An identification card intermediate comprising a ply of paper having one face coated with a generally rectangular patch of release material, a transparent film equipped with pressure sensitive adhesive on one surface thereof, said film one surface being adhesively secured to said paper one face over said patch, a generally rectangular die-cut in said paper and patch forming an identification card and patch portion, said identification card and patch portion occupying slightly less than one half of said patch and said identification card being located adjacent to one side of said generally rectangular patch portion, a generally rectangular die-cut in said film forming a cover for said identification card, said cover being slightly greater than twice the size of said identification card to provide a U-shaped connective portion when said film cover is folded on itself to encapsulate said identification card.

2. The intermediate of claim 1 in which said film overlays said patch to adhere said film to said paper and prevent inadvertent detachment of said film from said paper.

3. The intermediate of claim 1 in which said paper one face is equipped with pre-printed information and the other paper face is equipped with means for a signature.

4. The intermediate of claim 1 in which said film is equipped with a perforation adjacent said I.D. card.

5. A method of preparing an identification card comprising:

providing an identification card intermediate including a ply of paper having one face coated with a patch of release material, a transparent film equipped with pressure sensitive adhesive on one surface thereof, said film one surface being adhesively secured to said paper one face over said patch, an identification card die-cut in said paper occupying slightly less than one half of said patch, a die-cut in said patch forming a patch portion which is located adjacent to said identification card, a die-cut in said film slightly greater than twice the size of said paper die-cut to provide a cover for said identification card;

substantially simultaneously detaching said paper and said patch which is not adjacent to said identification card from said film and identification card and folding said film on itself to encapsulate said identification card.

6. The method of claim 5 in which said film is equipped with a line of perforation, said folding occurring on said line of perforation.

7. The method of claim 5 in which a signature space means is provided on the other face of said paper, and signing said space means.

* * * * *